US011957993B2

(12) United States Patent
Egli et al.

(10) Patent No.: US 11,957,993 B2
(45) **Date of Patent: *Apr. 16, 2024**

(54) VEHICLE HOPPING SYSTEM

(71) Applicant: Namero, LLC, Phoenix, AZ (US)

(72) Inventors: Alaric R. Egli, New River, AZ (US); Matthew R. Jackson, Mesa, AZ (US); Darin Oreman, Tempe, AZ (US); Jeroen de Vries, Almere (NL)

(73) Assignee: Namero, LLC, Phoenix, AZ (US)

( * ) Notice: Subject to any disclaimer, the term of this patent is extended or adjusted under 35 U.S.C. 154(b) by 46 days.

This patent is subject to a terminal disclaimer.

(21) Appl. No.: 17/367,090

(22) Filed: Jul. 2, 2021

(65) Prior Publication Data

US 2021/0339156 A1 Nov. 4, 2021

Related U.S. Application Data

(63) Continuation of application No. 16/181,223, filed on Nov. 5, 2018, now Pat. No. 11,083,973.

(60) Provisional application No. 62/584,038, filed on Nov. 9, 2017.

(51) Int. Cl.
*A63H 17/26* (2006.01)

(52) U.S. Cl.
CPC ..... *A63H 17/262* (2013.01)

(58) Field of Classification Search
CPC .... A63H 17/262; A63H 17/004; A63H 17/36; A63H 33/005; B60G 2500/30; B60G 15/00; B60G 15/062; B60G 15/067; B60G 17/021; B60G 2204/128; B60G 2204/129; B60G 2204/13
See application file for complete search history.

(56) References Cited

U.S. PATENT DOCUMENTS 2,167,245 A * 7/1939 Lohr ..... A63H 29/00 446/451
3,109,668 A * 11/1963 Sampietro ..... B62D 7/22 280/89
3,198,541 A * 8/1965 Christenson ..... B62D 7/1509 180/409
3,306,167 A * 2/1967 Ramseyer ..... F41A 19/08 89/27.11
3,423,099 A * 1/1969 De Mars ..... B60G 9/00 267/194
3,820,497 A * 6/1974 Konijn ..... B60F 3/0007 440/12.5
3,820,615 A * 6/1974 Bobard ..... B60B 35/109 280/638

(Continued)

FOREIGN PATENT DOCUMENTS

GB 2131363 A * 6/1984 ..... B64C 9/10

OTHER PUBLICATIONS

U.S. Appl. No. 62/584,038, filed Nov. 9, 2017.

(Continued)

*Primary Examiner* — Melba Bumgarner
*Assistant Examiner* — Amir A Klayman
(74) *Attorney, Agent, or Firm* — Craig R. Miles; CR MILES P.C.

(57) ABSTRACT

A toy vehicle suspension operable to lift and lower the vehicle chassis of the toy vehicle. In particular embodiments, the vehicle suspension transmits sufficient forces to the wheels of the toy vehicle to enable the wheels to hop off the ground.

15 Claims, 5 Drawing Sheets

(56) References Cited

U.S. PATENT DOCUMENTS 3,838,604 A * 10/1974 Meister ..... G05G 7/16 244/99.3
4,109,747 A * 8/1978 Hornagold ..... B60B 35/003 280/638
4,406,472 A * 9/1983 Furukawa ..... B62D 7/1527 280/93.502
4,573,941 A * 3/1986 Holden ..... A63H 17/38 446/454
4,600,216 A * 7/1986 Burkholder ..... B62D 9/02 280/62
4,696,655 A 9/1987 D'Andrade et al.
4,703,824 A * 11/1987 Irimajiri ..... B62D 61/065 180/215
4,999,003 A * 3/1991 Koishi ..... B62D 7/1527 280/103
5,020,308 A * 6/1991 Braun ..... B62D 51/002 56/11.5
5,334,077 A 8/1994 Bailey
5,485,653 A * 1/1996 Knowlton ..... A47L 11/4061 15/340.4
5,531,466 A * 7/1996 Hayashi ..... B62D 7/142 180/409
5,700,026 A * 12/1997 Zalewski ..... B60G 21/051 280/6.151
5,722,872 A 3/1998 Simmons et al.
5,785,576 A 7/1998 Belton
5,890,558 A * 4/1999 Keegan ..... E01H 1/00 280/103
6,015,330 A 1/2000 Simmons et al.
6,036,575 A 3/2000 Rehkemper et al.
6,383,054 B1 5/2002 Rauch
6,620,023 B2 9/2003 Yeung
6,679,752 B1 1/2004 Reed, Sr.
6,719,313 B2 * 4/2004 Zadok ..... B60G 17/021 280/5.509
6,758,719 B1 7/2004 Nava
6,767,272 B2 7/2004 Santarsiero
6,942,230 B1 * 9/2005 Fontdecaba Buj .... B60G 21/06 280/124.106
6,945,843 B1 9/2005 Motosko
7,108,096 B1 * 9/2006 Oxley ..... B62D 3/12 180/197
7,625,001 B2 * 12/2009 Pavuk ..... B60G 21/05 280/5.509
7,749,047 B2 7/2010 Dunham
7,887,074 B2 2/2011 Byers et al.
8,272,470 B2 * 9/2012 Karlsson ..... B62D 7/144 180/440
8,302,728 B1 * 11/2012 Dotson ..... A63H 17/262 180/408
8,607,914 B2 * 12/2013 Lee ..... B60G 3/00 280/137.5
10,603,955 B2 * 3/2020 Abramov ..... B60B 35/1072
11,117,434 B2 * 9/2021 Budweil ..... B60G 7/001
2002/0077026 A1 6/2002 Li
2003/0164603 A1 9/2003 Zadok
2009/0256326 A1 10/2009 Sacli
2011/0095505 A1 * 4/2011 Heath ..... B62M 1/12 74/496
2013/0062133 A1 * 3/2013 Budweil ..... B60B 35/1063 180/209
2013/0241168 A1 9/2013 Michel
2016/0016451 A1 1/2016 Izak

OTHER PUBLICATIONS

U.S. Appl. No. 16/181,223, filed Nov. 5, 2018.
PCT International Patent Application No. PCT/US18/59692, International Search Report and Written Opinion of the International Searching Authority dated Jan. 22, 2019, 14 pages.
Youtube. Wicked '67 RC Lowrider by Jervies . . . Video, https://www.youtube.com/watch?v=N8EQLClegqs, published Jan. 1, 2016.
Youtube. BeSwitched '67 RC scale lowrider by Jevries. Video, https://www.youtube.com/watch?v=H4bGX9rdAjk, published Apr. 2, 2015.
Youtube. RC '64 Chevy Impala at the Tokyo lowrider show 2011. Video, https://www.youtube.com/watch?v=F3JYhSFtIX8, published May 17, 2013.
Youtube. Lowrider RC Homie Hopper. Video, https://www.youtube.com/watch?v=Bc094uOH6nU, published Apr. 18, 2012.
Youtube. Hopping Homie Hopper. Video, https://www.youtube.com/watch?v=23UvilkvNMI, published Jul. 30, 2009.
Youtube. All my Homie Hoppers plus a few more lowrider toys. Video, https://www.youtube.com/watch?v=CKayyZtimf4, published Nov. 20, 2015.
Youtube. Homie Hoppers Blvd Bouncer. Video, https://www.youtube.com/watch?v=kJFnlB31d3U, published Feb. 2, 2013.
Youtube. Lindberg Homie Hoppers '63 Impara 1:18 R/C. Video, https://www.youtube.com/watch?v=tY6ZakfpZiA, published Mar. 26, 2017.
Youtube. Homie Hopper. Video, https://www.youtube.com/watch?v=H2mMDfN8hGs, published Jul. 15, 2009.
Youtube. 1964 Chevrolet Impala Model Lowrider Dancer on Servos Hydraulics. Video, https://www.youtube.com/watch?v=yPfFpDZZAr8, published Sep. 25, 2014.
Youtube. Hopping Homies Hopper 2. Video, https://www.youtube.com/watch?v=e7YjwkJLTSk, published Sep. 14, 2009.

* cited by examiner

VEHICLE HOPPING SYSTEM

This United States Patent Application is a continuation of U.S. patent application Ser. No. 16/181,223, filed Nov. 5, 2018, now U.S. Pat. No. 11,083,973, issued Aug. 10, 2021, which claims the benefit of U.S. Provisional Patent Application No. 62/584,038, filed Nov. 9, 2017, each hereby incorporated by reference herein.

I. FIELD OF THE INVENTION

A vehicle suspension operable to lift and lower the vehicle chassis of a toy vehicle. In particular embodiments, the vehicle suspension transmits sufficient force to the wheels of the toy vehicle to enable the wheels to hop off the ground.

II. SUMMARY OF THE INVENTION

A broad object of particular embodiments can be to provide a vehicle suspension apparatus including one or more of: a central bell crank pivotally mounted on a vehicle chassis to axially pivot along a longitudinal axis of the vehicle chassis; a first link having a first link end connected to a first bell crank pivotally mounted on the vehicle chassis to transversely pivot along a transverse axis across the longitudinal axis of the vehicle chassis and a second link end connected to the central bell crank; a second link adjacent to the first link and having a first link end connected to a second bell crank pivotally mounted on the vehicle chassis to transversely pivot along a transverse axis across the longitudinal axis of the vehicle chassis and a second link end connected to the central bell crank; and, a connecting rod pivotally connected at first end to the central bell crank and pivotally connected at a second end to a rotary actuator.

Another broad object of particular embodiments can be to provide a vehicle suspension apparatus including: a first adjustable-length member having a first mount connected to a first bell crank pivotally mounted on the vehicle chassis to transversely pivot along a transverse axis across the longitudinal axis of the vehicle chassis. A first vertical suspension assembly pivotally connected to the vehicle chassis interconnects a first wheel to a second mount of the first adjustable-length member.

Another broad object of particular embodiments can be to provide a vehicle suspension apparatus including: a second adjustable-length member having a first mount connected to a second bell crank pivotally mounted on the vehicle chassis to transversely pivot along a transverse axis across the longitudinal axis of the vehicle chassis. A second vertical suspension assembly pivotally connected to the vehicle chassis interconnects a second wheel to a second mount of the first adjustable-length member.

Another broad object of the invention can be to perform a method including one or more of: operating a rotary actuator to generate a pull force via a connecting rod connected to the rotary actuator; generating a radial force axially along a longitudinal axis of a vehicle chassis via a central bell crank connected to the connecting rod; transferring the radial force along a transverse axis across the longitudinal axis of the vehicle chassis via a first bell crank or a second bell crank linked to the central bell crank; and transmitting said radial force dispersed through the first bell crank or the second bell crank through corresponding first or second adjustable-length members to a first vertical suspension or a second vertical suspension assembly with sufficient force to enable the first or second wheel to hop off a support surface. In particular embodiments, the method can include concurrently transmitting said radial force dispersed through said first bell crank or said second bell crank through corresponding first and second adjustable-length members to a first vertical suspension and a second vertical suspension assembly with sufficient force to enable both first and second wheels to hop off the support surface.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
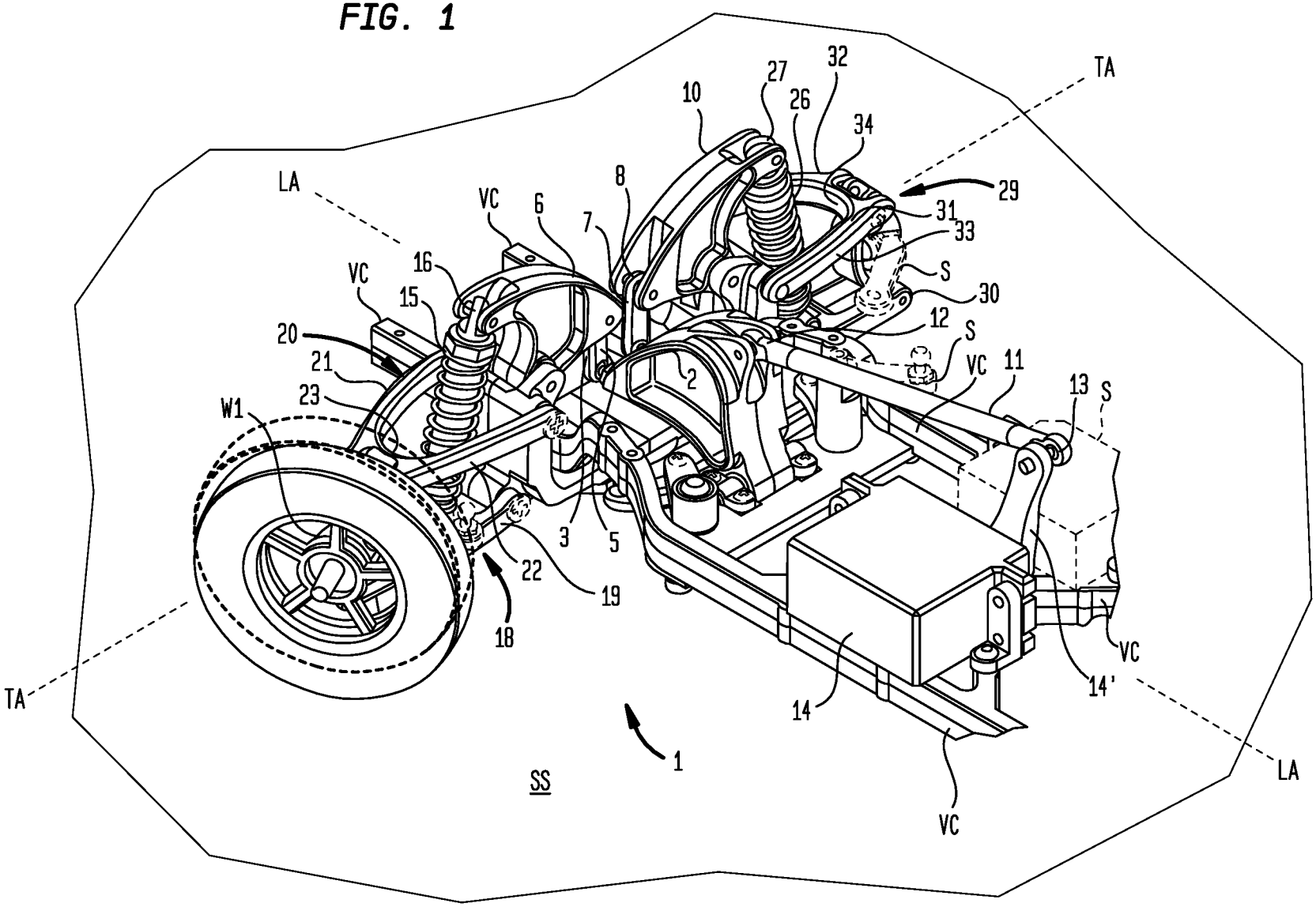
FIG. 1 is a top, left, perspective view of an embodiment of a vehicle suspension.

Generally, with reference to FIGS. 1 through 5 wherein like reference numerals denote like structure throughout the specification, embodiments of a vehicle suspension (1) include a central bell crank (2) pivotally mounted on a vehicle chassis (VC) to axially pivot along a longitudinal axis (LA) of the vehicle chassis (VC). A first bell crank (6) can be pivotally mounted on the vehicle chassis (VC) to transversely pivot along a transverse axis (TA) across the longitudinal axis (LA) of the vehicle chassis (VC). A first link (3) can have a first end (4) pivotally connected to the first bell crank (6) and can have a second end (5) pivotally connected to the central bell crank (2). In particular embodiments, a second bell crank (10) can be pivotally mounted on the vehicle chassis (VC) to transversely pivot along a transverse axis (TA) across the longitudinal axis (LA) of the vehicle chassis (VC). A second link (7) can have a first end (8) pivotally connected to the second bell crank (10) and a second end (9) pivotally connected to the central bell crank (2). A connecting rod (11) can be pivotally connected by a first end (12) to the central bell crank (2) and pivotally connected by a second end (13) to a rotary actuator (14). The rotary actuator (14) can include an actuator horn (14') connected to the second end (13) of the connecting rod (11).

In various embodiments, the central bell crank (2), the first bell crank (6), or the second bell crank (10) can be disposed in various structural forms capable of changing motion through an angle. The illustrative examples of the bell cranks (2) (6) or (10) shown in the Figures are not intended to preclude embodiments which incorporate similar or equivalent crank arms, crank levers, angled levers, suspension arms, or rocker arms, currently or prospectively available, and the fixed pivot or the moving pivots of the bell cranks (2) (6) or (10) can, but need not necessarily, further incorporate a bushing assembly or a bearing assembly to align, guide, or support the bell crank (2) (6) or (10) or reduce wear or friction. Further, while the illustrative examples may show pivot axes defined by pivot pins; this is not intended to preclude the use of pivot balls, pivot joints, ball joints, living hinges, or other structures which allow the fixed pivot or moving pivots of the bell cranks (2) (6) (10) to operate in relation to one another. Further, in various embodiments, the rotary actuator (14) can, but need not necessarily, be a commercially available servo motor used with toy and radio control vehicles. As an illustrative example, a servo motor suitable for use in embodiments can be a Redcat Racing Hexfly HX 15 s 200 oz waterproof high torque metal gear servo available from Redcat Racing, 3145 East Washington Street, Phoenix, Arizona 85034. However, this illustrative example of a rotary actuator (14) is not intended to preclude embodiments which incorporate similar or equivalent devices that produce rotary motion or torque, such as high speed and high torque servo motors, currently or prospectively available.

Again, referring primarily to FIGS. 1 through 5, in particular embodiments, the vehicle suspension (1) can further include a first adjustable-length member (15) having a first end mount (16) opposite a second end mount (17). The first adjustable-length member (15) connects to the first bell crank (6) at the first end mount (16). In particular embodiments, the first adjustable-length member (15) can, but need not necessarily, be a commercially available shock absorber or strut used in toy and radio control vehicles. As one illustrative example, an adjustable-length member (15) suitable for use in embodiments, can be a Redcat Racing Shock Absorber Part No. 86002 available from Redcat Racing, 3145 East Washington Street, Phoenix, Arizona 85034. However, the illustrative examples of the first adjustable-length member (15) described in the specification or shown in the Figures are not intended to preclude embodiments which incorporate similar or equivalent toy vehicle shock absorbers, currently or prospectively available. In yet further embodiments, the first adjustable-length members (15) can, but need not necessarily, be a rigid linkage connected to torsion bars, or the like, in or for use with adjustable height suspensions.

Figure 2:
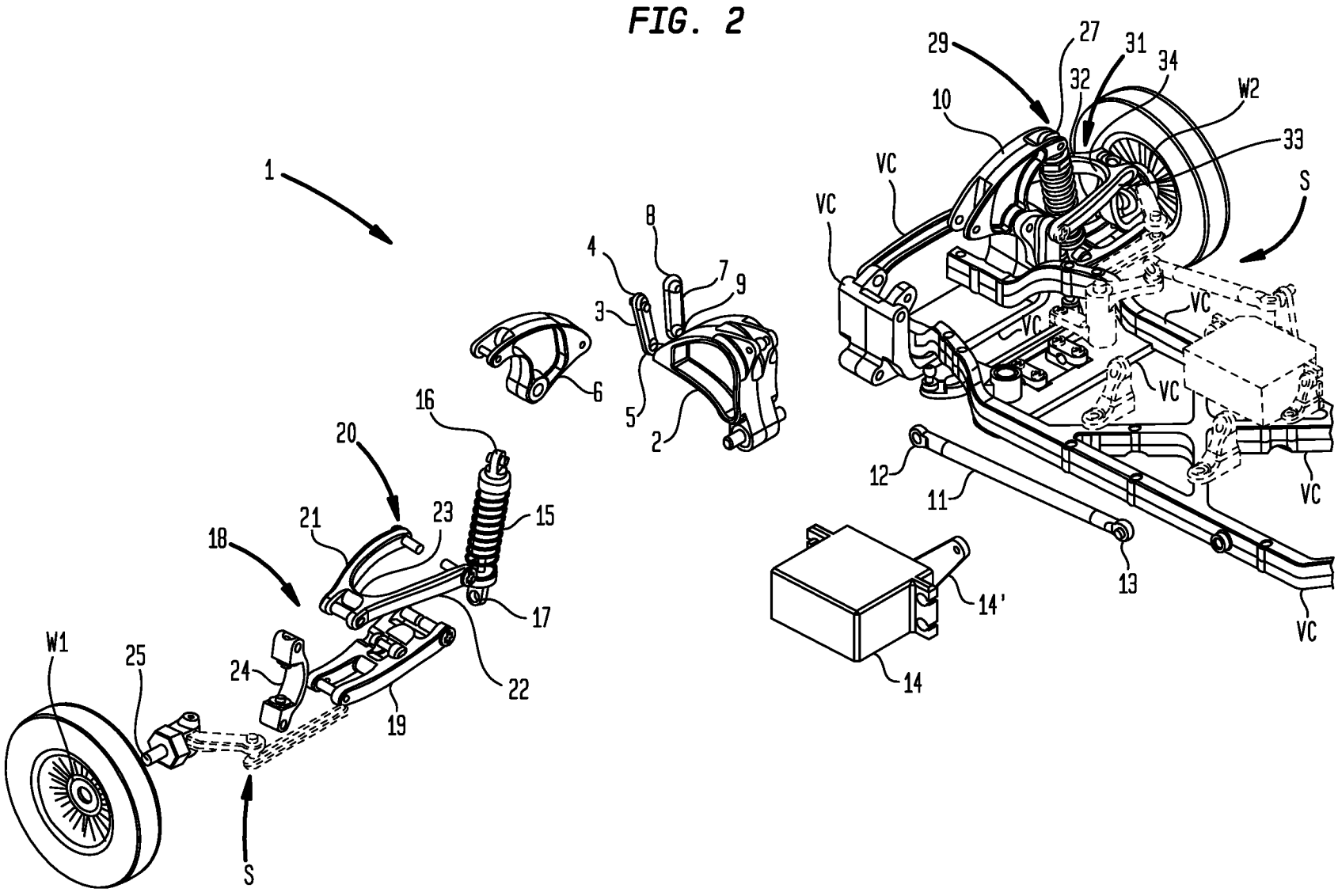
FIG. 2 is a partially exploded, perspective view of an embodiment of a vehicle suspension.
Figure 3:
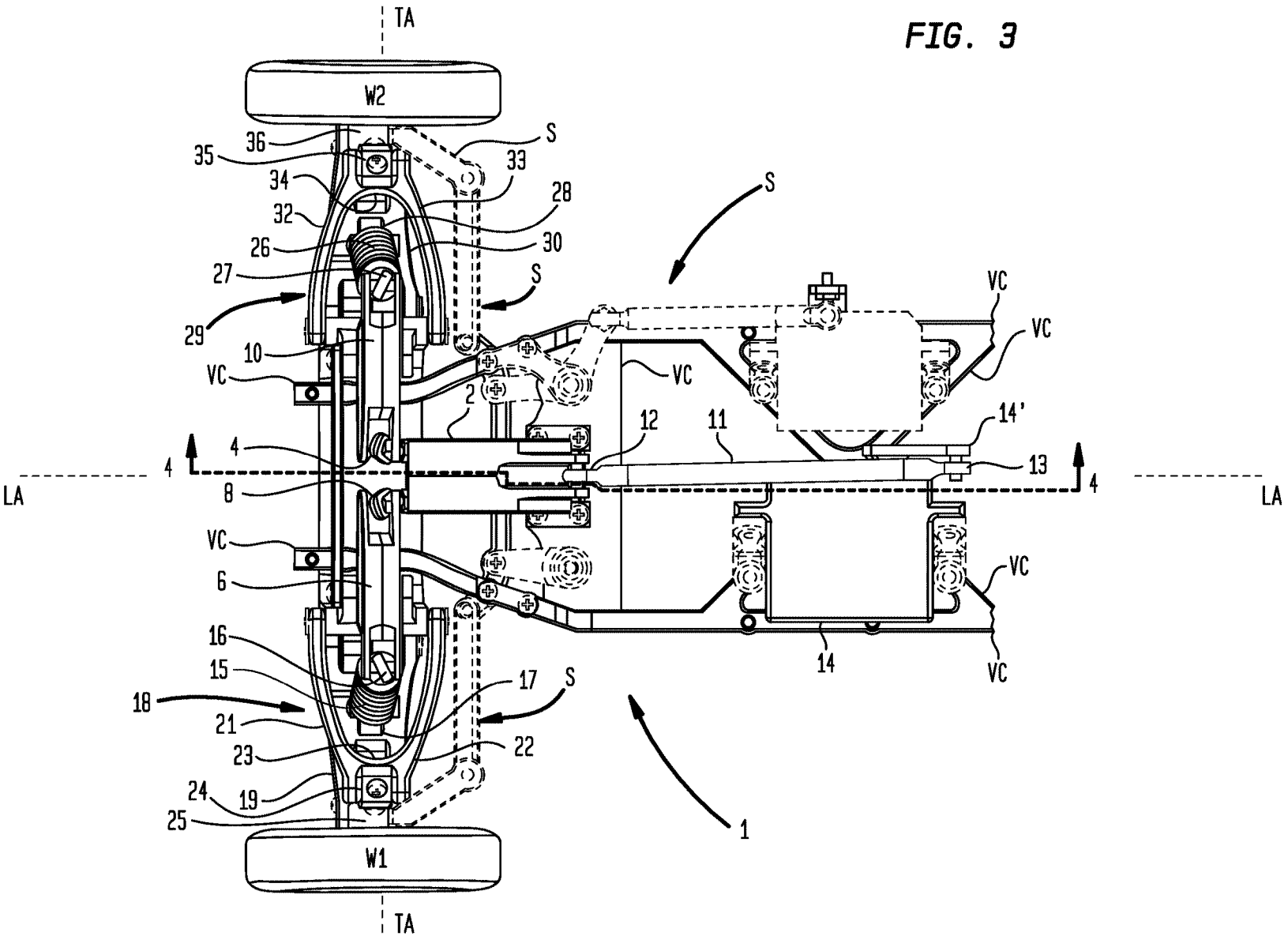
FIG. 3 is a top view of an embodiment of a vehicle suspension.

Now, referring primarily to FIGS. 1 through 3, embodiments of the vehicle suspension (1) can include a first vertical suspension assembly (18) pivotally coupled to the vehicle chassis (VC). The first vertical suspension assembly (18) interconnects a first wheel (W1) to the first adjustable-length member (15) allowing generally vertical movement of the first wheel (W1) in relation to the vehicle chassis (VC). In particular embodiments, the first vertical suspension assembly (18) can include a lower suspension linkage (19) extending from a pivotal coupling on the vehicle chassis (VC) to connect with the second mount (17) of the first adjustable-length member (15), and a first upper wishbone linkage (20) having a first arm (21) and a second arm (22) extending in general parallel relationship to one another (21, 22) from corresponding pivotal couplings on the vehicle chassis (VC) to a first knuckle (23). The first wishbone linkage (20) disposed above the first lower suspension linkage (19), aligns the first mount (16) of the first adjustable-length member (15) connected to the first bell crank (6) with the second mount (17) of the first adjustable-length member (15) connected to the first lower suspension linkage (19) allowing the first adjustable-length member (15) to pass between the first arm (21) and the second arm (22) of the first upper wishbone linkage (20). A first two-ended member (24) can interconnect the first upper wishbone linkage (20) to the first lower suspension linkage (19). A first axle (25) can be rotatably mounted in the first two-ended member (24). The first wheel (W1) can be rotatably coupled to the first axle (25).

Again, referring primarily to FIGS. 1 through 3, the vehicle suspension (1) can further include a second adjustable-length member (26). The second adjustable-length member (26) can have a first mount (27) connected to the second bell crank (10). In substantially similar structural arrangement to the first vertical suspension assembly (18), embodiments can further include, a second vertical suspension assembly (29). The second vertical suspension assembly (29) interconnects a second wheel (W2) to the second adjustable-length member (26). The second vertical suspension assembly (29) can include a second lower suspension linkage (30) connected to a second mount (28) of the second adjustable-length member (26). A second upper wishbone linkage (31) includes a first arm (32) and a second arm (33) which correspondingly extend from pivotal couplings on the vehicle chassis (WC) in a substantially parallel relationship to a second common knuckle (34). The second upper wishbone linkage (31) can be disposed above the second lower suspension linkage (30), to align the first mount (27) of the second adjustable-length member (26) connected to the second bell crank (10) with the second mount (28) of the second adjustable-length member (26) connected to the second lower suspension linkage (30) allowing the second adjustable-length member (26) to pass between the first arm (32) and the second arm (33) of the second upper wishbone linkage (31). The vertical suspension assembly (29) can include a second two-ended member (35) which interconnects the second upper wishbone linkage (31) to the second lower suspension linkage (30). A second axle (36) can be rotatably mounted in the second two-ended member (35). The second wheel (W2) can be rotatably coupled to the second axle (36).

Again, referring primarily to FIGS. 1 through 5, in particular embodiments, the central bell crank (2) can be pivotally mounted on the vehicle chassis (VC) to axially pivot along the longitudinal axis (LA) of the vehicle chassis (VC) interconnecting the connecting rod (11) to the first link (3) and second link (7). The first link (3) and second link (7) can be disposed side-by-side to one another in vertical orientation to connect second ends (5) (9) to the central bell crank (2). Each of the first ends (4), (8) of the first link (3) and the second link (7) can correspondingly couple to the first bell crank (6) and second bell crank (10) each mounted to the vehicle chassis (VC) to transversely pivot across the longitudinal axis (LA) of the vehicle chassis (VC). Operation of the rotary actuator (14) moves the connecting rod (11) to generate operative interconnection between the central bell crank (2), the first bell crank (6) and the second bell cranks (10) to concurrently transfer sufficient force through the first adjustable-length member (15) and the second adjustable-length member (26) to downwardly lower the first vertical suspension assembly (18) and the second vertical suspension assembly (29) in relation to the vehicle chassis (VC) to correspondingly upwardly raise the vehicle chassis (VC) in relation to the support surface (SS). In particular embodiments, the downward movement of the first vertical suspension assembly (18) and the second vertical suspension assembly (29) can occur with sufficient force to cause the first wheel (W1) and the second wheel (W2) to hop off the support surface (SS), whether the vehicle is either stationary or in motion. In particular embodiments, the rotary actuator (14) can be repeatedly actuated to cause a repeated hopping motion of the vehicle chassis (VC) in relation to the support surface (SS).

Now referring primarily to FIGS. 1, 2 and 3, the rotary actuator (14) can, but need not necessarily, have a square center section with opposite extending brackets for mounting to the vehicle chassis (VC). The rotary actuator (14) in operation via radio control, can be connected to an offset actuator horn (14'), which can be connected to a second end (13) of the connecting rod (11). When the rotary actuator (14) actuates the connecting rod (11), the radial movement of the actuator horn (14') can converted into linear movement in the form of a rearward pull of the connecting rod (11).

Figure 4:
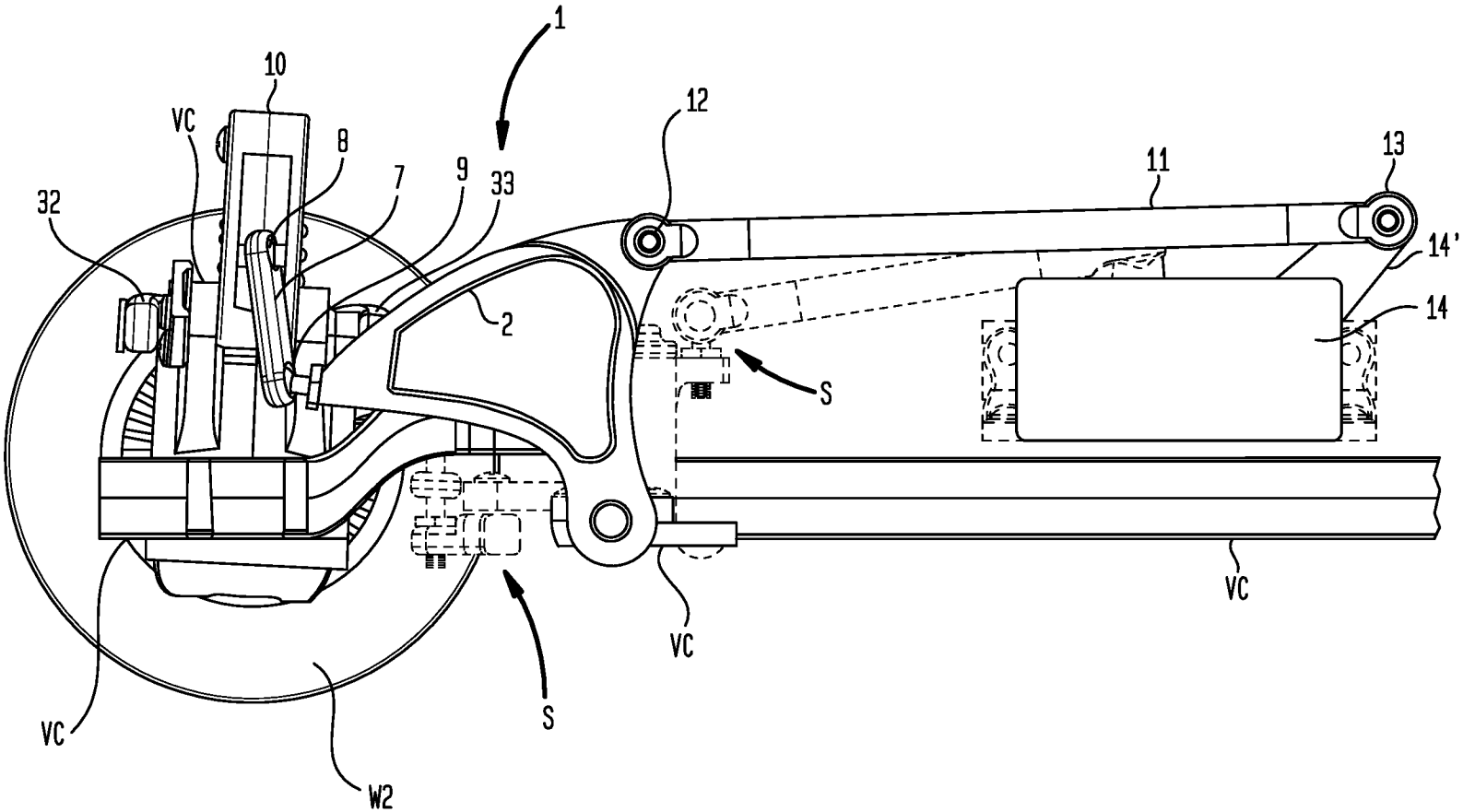
FIG. 4 is a cross-sectional view 4-4 of an embodiment of a vehicle suspension shown in FIG. 3.
Figure 5:
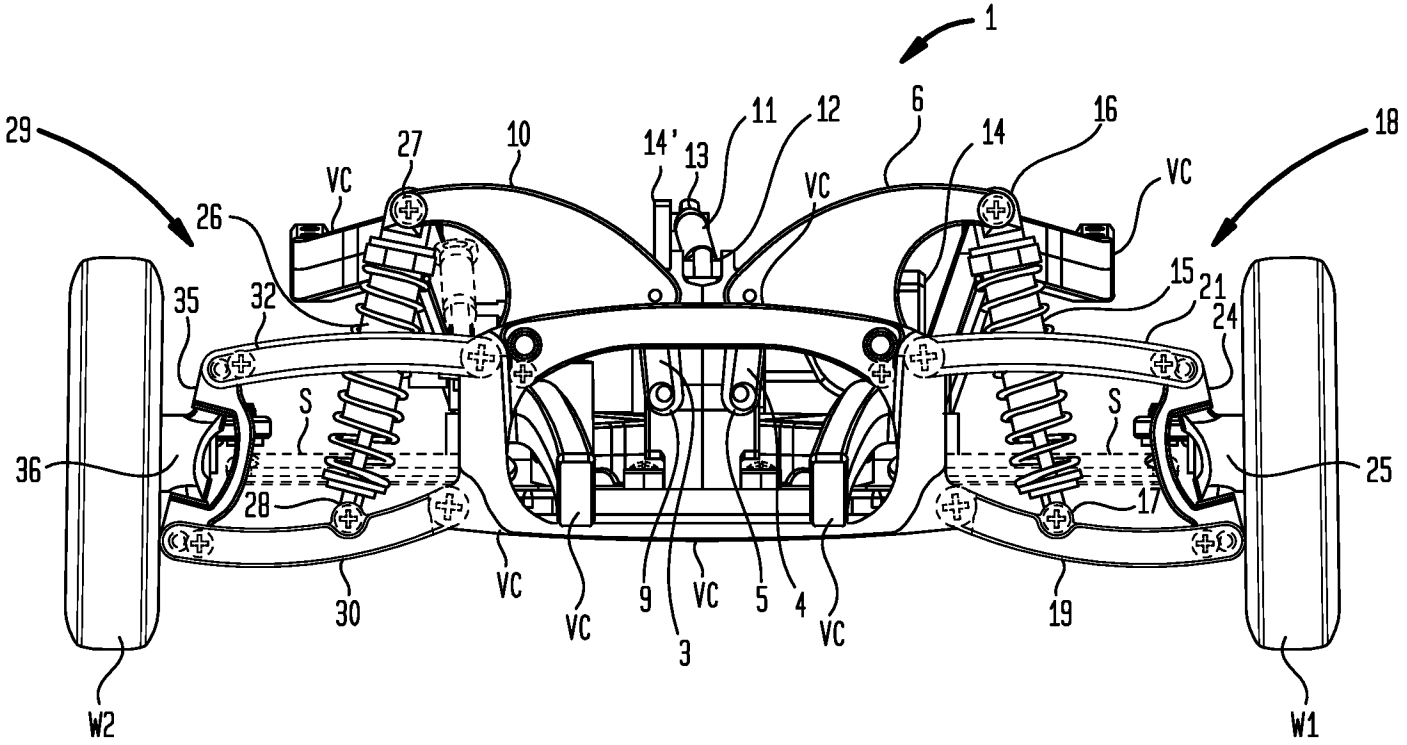
FIG. 5 is a front view of an embodiment of a vehicle suspension.

Now, referring primarily to FIGS. 3 and 4, a steering linkage (S) (shown in broken line) can, but need not necessarily, be operated by a second rotary actuator via radio control.

As can be easily understood from the foregoing, the basic concepts of the present invention may be embodied in a variety of ways. The invention involves numerous and varied embodiments of a vehicle suspension apparatus, a method of making a vehicle suspension, a method of using a vehicle suspension apparatus to make a remote control car hop, and the component parts thereof, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "crank" should be understood to encompass disclosure of the act of "cranking"—whether explicitly discussed or not—and, conversely, were there effectively disclosure of the act of "cranking", such a disclosure should be understood to encompass disclosure of a "crank" and even a "means for cranking." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) the vehicle suspension apparatus disclosed and described, ii) the related methods and systems disclosed and described, iii) similar, equivalent, and even implicit variations of each of the structure and method, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A method of making a vehicle suspension for a toy vehicle, comprising:

pivotally mounting a central bell crank on a vehicle chassis, said central bell crank having a central bell crank pivot axis extending laterally across a central longitudinal axis of said vehicle chassis, said central bell crank rotates about said pivot axis extending laterally across said central longitudinal axis of said vehicle chassis and along said central longitudinal axis of said vehicle chassis;

pivotally mounting a first bell crank on said vehicle chassis, said first bell crank having a first bell crank pivot axis extending longitudinally across a transverse axis of said vehicle chassis, said first bell crank rotates about said first bell crank pivot axis extending across said transverse axis of said vehicle chassis and along said transverse axis of said vehicle chassis;

connecting a first end of a first link to said first bell crank and connecting a second end of said first link to said central bell crank;

connecting a first mount of first adjustable-length member to said first bell crank;

connecting a second mount of said first adjustable-length member to a first vertical suspension assembly pivotally coupled to said vehicle chassis;

interconnecting said first vertical suspension assembly to a first wheel; and pivotally connecting a first end of a connecting rod to said central bell crank and pivotally connecting a second end of said connecting rod to a rotary actuator, wherein operation of said rotary actuator generates linear movement of said connecting, rod to generate operative interconnection of said central bell crank, said first bell crank and said first adjustable-length member to move said first vertical suspension assembly.

2. The method of claim 1, wherein said rotary actuator comprises servo motor.

3. The method of claim 1, wherein said second mount of said first adjustable-length member connects to a first lower suspension linkage of said first vertical suspension assembly.

4. The method of claim 3, further comprising disposing a first upper wishbone linkage of said first vertical suspension assembly above said first lower suspension linkage, said first upper wishbone linkage having a first arm and a second arm each extending outward from a pivotal coupling on said vehicle chassis to a first knuckle.

5. The method of claim 4, further comprising:

connecting said first upper wishbone linkage and said first lower suspension linkage to a first two-ended member;

rotatably mounting a first axle in said two-ended member; and rotatably coupling said first wheel to said first axle.

6. The method of claim 1, wherein said first adjustable-length member comprises a first shock absorber.

7. The method of claim 1, further comprising:

pivotally mounting a second bell crank on said vehicle chassis, said second bell crank having a second bell crank pivot axis extending longitudinally across a transverse axis of said vehicle chassis, said second bell crank rotates about said second bell crank pivot axis extending across said transverse axis of said vehicle chassis and along said transverse axis of said vehicle chassis;

connecting a first end of a second link to said second bell crank and connecting a second end of said first link to said, central bell crank;

connecting a first mount of a second adjustable-length member to said second bell crank;

connecting a second mount of said second adjustable-length member to a second vertical suspension assembly pivotally coupled to said vehicle chassis; and interconnecting said second vertical suspension assembly to a second wheel.

8. The method of claim 7, wherein said second mount of said second adjustable-length member connected to a second lower suspension linkage of said second vertical suspension assembly.

9. The method of claim 8, further comprising disposing a second upper wishbone linkage of said second vertical suspension assembly above said second lower suspension linkage, said second upper wishbone linkage having a first arm and a second arm each extending outward from a pivotal coupling on said vehicle chassis to a second knuckle.

10. The method of claim 9, further comprising:

connecting said second upper wishbone linkage and said second lower suspension linkage to a first two-ended member;

rotatably mounting a second axle in said two-ended member; and rotatably coupling said second wheel to said second axle.

11. The method of claim 1, wherein said second adjustable-length member comprises a first shock absorber.

12. The method of claim 1, wherein said vehicle is a radio control car.

13. The method of claim 12, further comprising operating said rotary actuator by a radio control.

14. The method of claim 1, further comprising:

generating a pull force in said connecting rod between said central bell crank and said rotary actuator; and causing said first wheel and a second wheel to dependently move downward.

15. The method of claim 1, further comprising:

generating a push force from in said connecting rod between said central bell crank and said rotary actuator; and causing said first wheel and a second wheel to dependently move upward.

* * * * *